US005810362A

United States Patent [19]

Jensen

[11] Patent Number: 5,810,362

[45] Date of Patent: Sep. 22, 1998

[54] TOY GAME

[75] Inventor: Finn H. Jensen, Newmarket, Canada

[73] Assignee: Jenmar Toys Limited, Central, Hong Kong

[21] Appl. No.: 703,759

[22] Filed: Aug. 27, 1996

[51] Int. Cl.[6] ..... A63F 7/20

[52] U.S. Cl. ..... 273/317.3; 273/108.52; 273/108.56

[58] Field of Search ..... 273/317.3, 108.52, 273/108.54, 108.55, 108.56, 129 V, 129 W, 129 R, 119 R, 126 R, 317.1, 337, 338

[56] References Cited

U.S. PATENT DOCUMENTS

| | | | |
|---|---|---|---|
| 2,735,682 | 2/1956 | Sweet | 273/317.3 |
| 2,783,754 | 3/1957 | Heiss | 273/317.3 |
| 3,416,799 | 12/1968 | Lopez | 273/317.3 |
| 3,537,707 | 11/1970 | Goldberg | 273/317.3 |
| 3,781,010 | 12/1973 | Matsumoto | 273/317.3 |
| 3,856,303 | 12/1974 | Payne | 273/317.3 |
| 3,899,173 | 8/1975 | Zaris | 273/317.3 |
| 3,901,508 | 8/1975 | Spangler | 273/317.3 |
| 3,977,675 | 8/1976 | Leuthy | 273/108.52 |

FOREIGN PATENT DOCUMENTS

| | | | |
|---|---|---|---|
| 1040225 | 10/1953 | France | 273/85 D |
| 1085943 | 2/1955 | France | 273/85 D |
| 504648 | 12/1954 | Italy | 273/85 D |
| 329073 | 4/1958 | Switzerland | 276/85 D |

*Primary Examiner*—Sebastiano Passaniti
*Attorney, Agent, or Firm*—Rogers & Scott

[57] ABSTRACT

A board game is provided having a generally rectangular game board including an undulating bottom surface defining parallel valleys having a part cylindrical shape and formed about parallel axes extending transversely of the board. Ball player assemblies are mounted to rotate about respective ones of the parallel axes, and slidable axially so that a game player can move the ball player into position to pick up a ball lying in an associated one of the valleys below the ball player. Targets are mounted on the respective end walls and each of the ball players has a body and an arm assembly rotatable relative to the body for rotation between a pick-up and a delivery position about the axis. The arm assembly defines a scoop which moves adjacent the valley to engage a ball and, after receiving the ball, the ball can be projected by continuing the movement and stopping suddenly so that the ball flies out of the scoop and towards a target.

11 Claims, 3 Drawing Sheets

TOY GAME

FIELD OF THE INVENTION

This invention relates to a board game which can be adapted to simulate real ball games, and in particular the game of basketball.

BACKGROUND OF THE INVENTION

Board games often have as a basis a team game such as basketball, football, etc. The concept is that the rules will generally follow the real game and allow two players to compete with one another in an environment in which they draw analogies with the real game. However, the board game usually differs greatly from the real game and the skills required to play the board game are quite different from those needed in the real game. Nevertheless, the players derive competition and excitement from the playing of such board games.

The present invention can be modified for use with different board games simulating real games but is primarily intended for use to simulate the game of basketball. Accordingly, the invention will be described with particular reference to basketball but will be appreciated that the invention can be adapted to be used in other board games which may or may not be based on real games.

U.S. Pat. No. 4,260,152 to Karlsen illustrates a board game which can be used to simulate the game of basketball. The structure is typical of many board games in which a simulated player must control a ball by first receiving the ball, and then position it for projecting it in a controlled fashion. It will be seen in this patent that the players are in the form of ball control devices having two opposite scoops. One scoop is used to pick up the ball and then the ball is rolled into the second scoop from which it is projected by the player. This action, although different from that used in other earlier games, illustrates a common difficulty in that the player is required to manipulate the ball in a very unnatural fashion which does not correspond in any way to the manner in which the ball would be manipulated in a real game. The skills required to manipulate the ball have little bearing on projecting the ball and detract from the enjoyment that the board game would provide.

It is an object of the present invention to provide a board game having simulated players which are used to project the ball and in which the simulated player has to be moved in a more natural fashion to project the ball so that the persons playing the game will derive more pleasure from the game.

SUMMARY OF THE INVENTION

A board game is provided having a generally rectangular game board including an undulating bottom surface defining parallel valleys having a part cylindrical shape and formed about parallel axes extending transversely of the board. Ball player assemblies are mounted to rotate about respective ones of the parallel axes, and slidable axially so that a game player can move the ball player into position to pick up a ball lying in an associated one of the valleys below the ball player. Targets are mounted on the respective end walls and each of the ball players has a body and an arm assembly rotatable relative to the body for rotation between a pick-up and a delivery position about said axis. The arm assembly defines a scoop which moves adjacent the valley to engage a ball and, after receiving the ball, the ball can be projected by continuing the movement and stopping suddenly so that the ball flies out of the scoop and towards a target.

DESCRIPTION OF THE PREFERRED EMBODIMENT(S)

Figure 1:
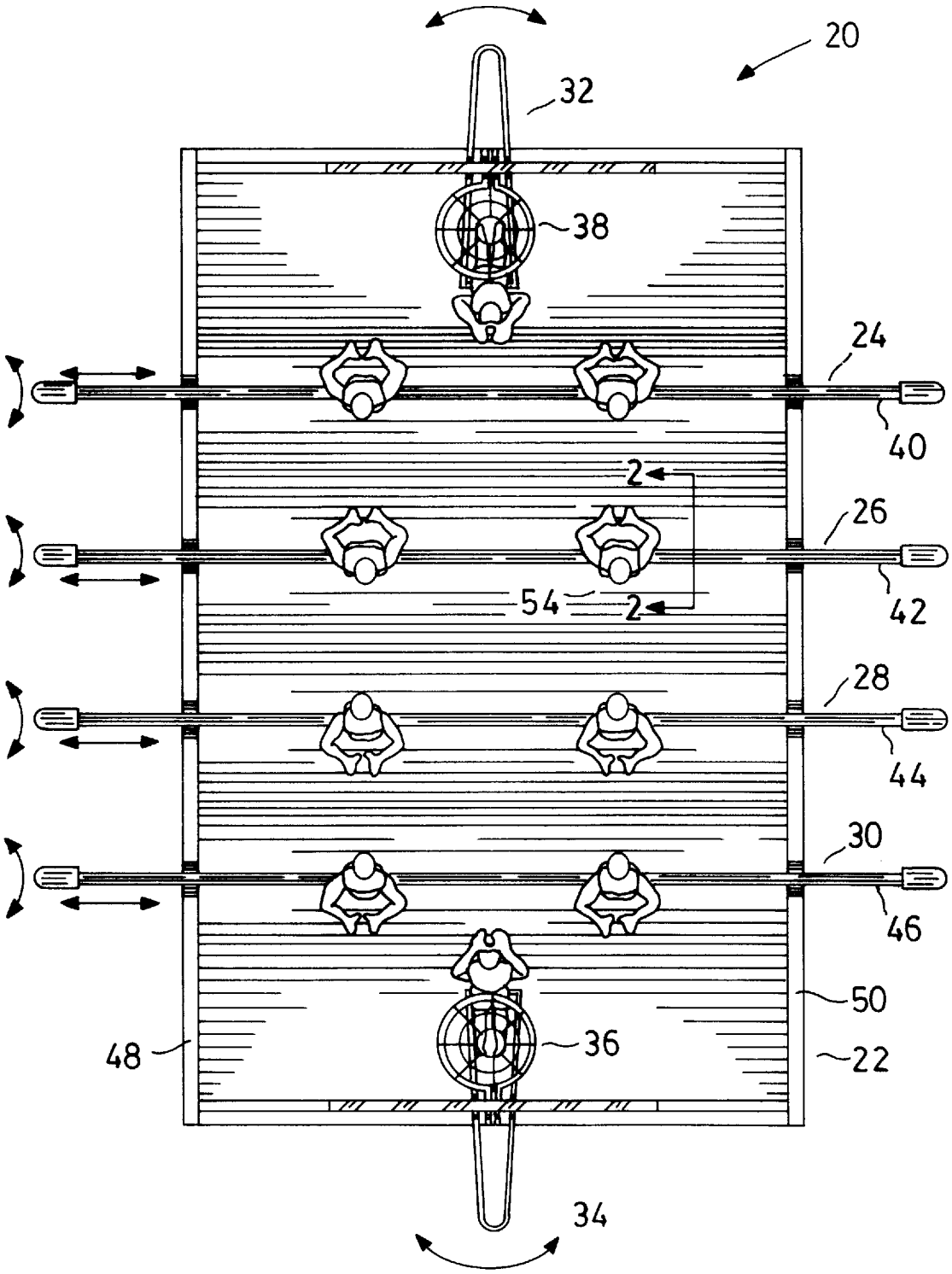
FIG. 1 is a top view of a board game according to a preferred embodiment of the invention.

Reference is first made to FIG. 1 which illustrates a preferred embodiment of the invention adapted for use as a simulated basketball game. The board game is designated generally by the numeral 20 and includes a game board 22 which carries 4 sets of ball player assemblies 24, 26, 28, and 30. Defender assemblies 32, 34, are positioned at respective first and second ends of the board and, in the arrangement shown, the defender assembly 32 is manipulated by a game player who also manipulates the ball player assemblies 24, 26. At the other end, the second game player manipulates the defender assembly 34 and ball player assemblies 28, 30. The simulated players are colour coded so that the "teams" are distinguished from one another.

As will become evident, the player assemblies can be interchanged. For instance, the players could agree to switch assemblies 26 and 28 resulting in a different distribution of player assemblies to give a different challenge for the game players.

The actual operation of the player and defender assemblies will be described with reference to subsequent drawings, but for the moment it is sufficient to understand that the object is to use the player assemblies to project the ball past the opponent's defender assembly and into the opponent's net. In other words a player at the first end is attempting to place the ball in a net 36 whereas the opposing player is attempting to place the same ball in the net 38.

Figure 2:
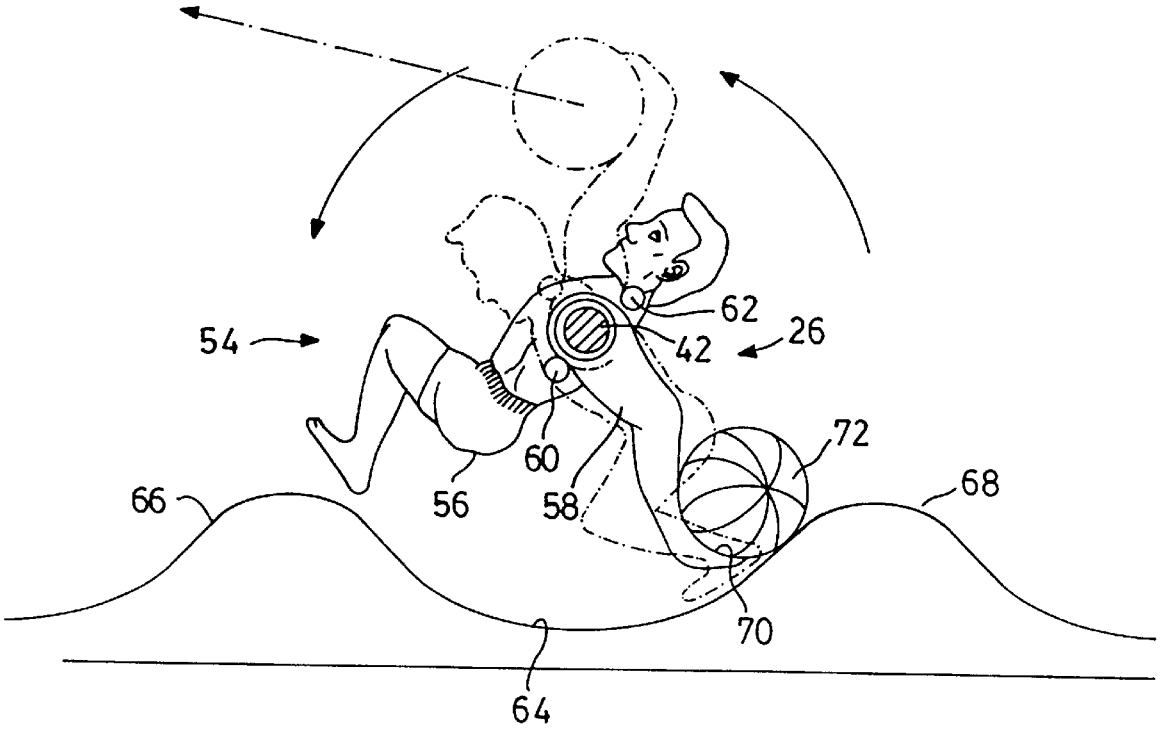
FIG. 2 is a side view on line 2—2 of FIG. 1 and illustrating a simulated ball player being manipulated to throw a ball, the ball player being drawn to a larger scale than that shown in FIG. 1.
Figure 3:
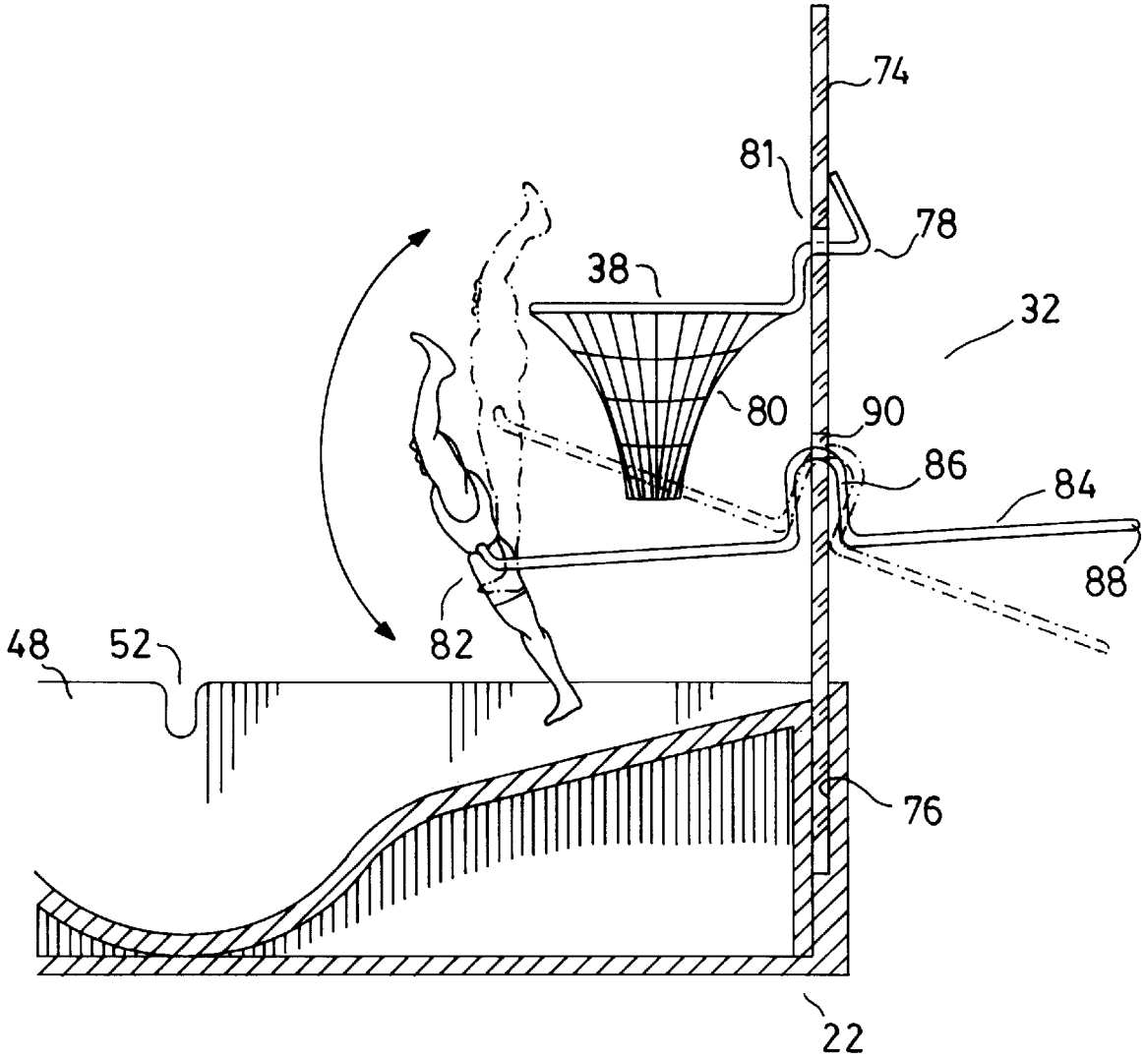
FIG. 3 is a side view on line 3—3 of FIG. 1 and illustrating a simulated defender for operation by the game player to defend against shots thrown towards a net where points are scored.

FIG. 2 is a sectional view of the ball player assembly 26 and is typical of such views of the other assemblies. As seen in FIG. 1, the assemblies 24 to 30 include respective rods 40, 42, 44, and 46 which rest on side walls 48, 50 in U-shaped depressions such as depression 52 seen in of FIG. 3. The depressions in each pair in the walls 48, 50 are aligned to receive one of the rods so that the rods are in parallel arrangement and generally at right angles to a line drawn between the nets 36, 38.

Returning to FIG. 2, the ball player assembly 26 includes an exemplary simulated ball player 54 having a body 56 attached to a rod 42. As a result, the person playing the game can rotate the rod 42 and cause the body 56 to move with the rod. The simulated ball player 54 also includes an arm assembly 58 which is pivotally mounted to either side of the body (see FIG. 1) about rod 42. The assembly simulates a pair of arms meeting at the hands and is in fact a U-shaped structure to ensure that the arms move in unison. The assembly is free to move about the axis of rod 42 between a lower stop 60 and an upper stop 62 attached to the body 56. There is therefore a limited range of motion for the arm assembly 58.

The simulated body 56 is shaped so that as it rotates about the axis of rod 42, it will pass quite closely to a valley 64 positioned between a pair of raised portions 66, 68. The valley is cylindrical in form with the centre of the form being the axis of the rod 42. There are similar depressions below each of the ball player assemblies shown in FIG. 1 so that any ball rolling freely on the board will find its way into one of the cylindrical depressions below a corresponding ball player assembly. This first location of the ball is necessary so that the simulated ball player 54 can pick up the ball as will be described.

The shape of the body 56 is not significant but is preferably somewhat similar to a person to give the overall general impression that a basketball game is being simulated. However, the arm assembly 58 has some limitations necessary to ensure that it has a proper function. The outer end of the arm assembly defines a scoop 70 shaped to receive a ball 72 and proportioned so that when the arm assembly 58 is rotated in an anti-clockwise direction ( as drawn in FIG. 2), the ball is pushed up the valley towards the raised portion 68 and a point is reached where the ball is retained in the arm assembly so that it can be lifted out of the valley with the arm assembly. The necessary movement is achieved by rotating the rod 42 so that the body 56 moves anti-clockwise and the lower stop 60 engages the arm assembly 58 to drive the arm assembly with the body. The person playing the game can then accelerate the rod 42 in an angular fashion so that the body rotates quickly in an anti-clockwise direction. The rod is then stopped suddenly and the momentum that has been built up in the free moving arm assembly 58 and ball 72 results in the assembly and ball continuing angular motion about the rod until the arm assembly 58 meets the upper stops 62. At this point the arm assembly stops but the ball continues through the air using up the energy developed in accelerating the ball from the pick up position shown in FIG. 2 to the release position shown in ghost outline. The ball will then follow a trajectory dependant upon the point of release.

It should be noted that the ball players are attached to the respective rods such that the rod can be used to position each of the players on a line between the nets to give a direct shot to the net.

A player soon learns to pick up the ball and project it in one motion and because of this, it is possible to change the point of release so that the trajectory of the ball is also changed. This becomes important because the player may be close to the target net or further away from it.

The gradual development of skills enabling the person playing a game to project the ball into the opponent's net or target develops an interest and results in satisfaction and pleasure for the person playing the game.

When one of the persons playing the game is attacking, the other is defending. As mentioned earlier, defender assemblies 32, 34 are provided and one of the assemblies 32 is illustrated in more detail in FIG. 3.

The assembly 32 is typical of both assemblies 32, 34 and includes a back board 74 slidably engaged in a slot 76 formed in the end structure of the board 22. The back board is generally rectangular and supports net 38 which acts as a target for a player attacking this end of the board. The net is a simple wire frame 78 supporting a flexible net 80. The frame 78 engages in an opening 81 in the back board and can be removed and replaced if necessary. Below the net, a defender 82 is suspended on an end of a manipulator 84 which includes a locating U-shaped portion 86 and an outer end 88 for the user to grip and move the defender 82. The U-shaped portion is engaged in an opening 90 in the back board 74 and this also can be removed from the back board for service if necessary. The defender 82 is fixed to an end of the manipulator 84 and will move both vertically and horizontally within the limitations set by the shape of the U-shaped portion 86 in the opening 90. This generally allows a vertical motion between the lower position shown in full outline in FIG. 3 and an upper position shown in ghost outline where the player projects above the basket and will intercept shots having a trajectory directly towards the basket. This is similar to the real game because if the ball is projected against the back board and made to drop into the net, then this will overcome the defender's attempt to reject the shot.

It will be appreciated that the ball players described with reference to FIGS. 1 and 2 could be used in any game where a ball is picked up and thrown. It is within the scope of the invention to make use of the players in this way and such variations are within the scope of the invention as claimed.

I claim:

1. A game comprising:

a generally rectangular game board extending longitudinally and having an undulating bottom surface defining parallel valleys and raised portions between the valleys, the valleys having a part cylindrical shape and formed about parallel axes extending transversely of the board, the game board further including side supports and end structures;

ball player assemblies mounted on said side supports and including at least one ball player operable to rotate about respective ones of said parallel axes, and slidable axially so that the ball player can be moved into position to pick up a ball lying in an associated one of the valleys below the ball player;

targets mounted on the respective end structures; and each of the ball players having a body and an arm assembly rotatable relative to the body for rotation between a pick-up and a delivery position about said axis, the body and the arm assembly defining stop structure to prevent movement beyond the delivery position, and the arm assembly defining a scoop which moves adjacent the valley to engage a ball and receive the ball by pushing the ball up the valley towards an adjacent said raised portion and then continuing the movement until the stop structure prevents further movement so that the arm stops suddenly on reaching the delivery position thereby causing the ball to fly out of the scoop and towards one of the targets.

2. A game as claimed in claim 1 and further comprising defender assemblies attached one to each of the end structures and including the targets, each of the defender assemblies including a movable defender operable to block the ball as the ball approaches the target.

3. A game as claimed in claim 1 in which the stop structure includes upper and lower stops on the ball players, the stops being engaged by the arm assembly to define said pickup and delivery positions.

4. A game as claimed in claim 1 in which each of the ball player assemblies includes a rod engaged on said side supports and about a respective one of said parallel axes for sliding movement axially and angular movement, each of the rods having at least one of the ball players attached to the rod, the arm assemblies being rotatable relative to the rods.

5. A game as claimed in claim 2 in which the defender is movable upwardly from a rest position into a blocking position where the defender will block some shots aimed at the target.

6. A game as claimed in claim 1 in which the targets are in the form of suspended basketball nets proportioned to receive the ball.

7. A game as claimed in claim 1 in which the arm assemblies include two arms made to resemble human arms and being linked at the hands to form said scoop.

8. A game as claimed in claim 4 in which the arm assemblies include two arms made to resemble human arms and being linked at the hands to form said scoop.

9. A game as claimed in claim 1 in which the end structures include back boards for deflecting shots towards the respective targets.

10. A game as claimed in claim 6 in which the end structures include back boards for deflecting shots into the basketball nets.

11. A game as claimed in claim 10 and further comprising defenders and manipulators attached to the respective defenders and coupled to the back board for limited vertical movement so that the defender can be moved to block shots on the adjacent one of the basketball nets.

* * * * *